US008079323B2

(12) United States Patent
Yoshikawa et al.

(10) Patent No.: US 8,079,323 B2
(45) Date of Patent: Dec. 20, 2011

(54) LIQUID WIPING APPARATUS

(75) Inventors: Masashi Yoshikawa, Hiroshima (JP); Tatsuya Hirano, Hiroshima (JP); Hironori Fujioka, Hiroshima (JP); Takanori Nagai, Hiroshima (JP)

(73) Assignee: Mitsubishi-Hitachi Metals Machinery, Inc., Tokyo (JP)

( * ) Notice: Subject to any disclaimer, the term of this patent is extended or adjusted under 35 U.S.C. 154(b) by 924 days.

(21) Appl. No.: 12/081,020

(22) Filed: Apr. 9, 2008

(65) Prior Publication Data

US 2008/0295766 A1 Dec. 4, 2008

Related U.S. Application Data

(62) Division of application No. 11/092,576, filed on Mar. 29, 2005, now abandoned.

(30) Foreign Application Priority Data

Apr. 13, 2004 (JP) ..... 2004-117468

(51) Int. Cl.
*B05C 11/06* (2006.01)

(52) U.S. Cl. ..... 118/62; 118/63; 118/101; 118/123; 15/309.1

(58) Field of Classification Search ..... 118/62, 118/63, 101, 123; 427/349, 356, 369, 434.2, 427/435; 15/309.1
See application file for complete search history.

(56) References Cited

U.S. PATENT DOCUMENTS

| | | | |
|---|---|---|---|
| 3,260,577 | A | 7/1966 | Mayhew |
| 3,681,118 | A | 8/1972 | Ohama et al. |
| 4,612,215 | A | 9/1986 | Hennechart et al. |
| 5,313,685 | A | 5/1994 | Kramer et al. |

FOREIGN PATENT DOCUMENTS

| | | | |
|---|---|---|---|
| EP | 0126057 | A | 11/1984 |
| EP | 0 565 272 | A1 | 10/1993 |
| EP | 0 933 442 | A1 | 8/1999 |
| JP | 51-2631 | A | 1/1976 |
| JP | 54-93636 | A | 7/1979 |
| JP | 54-93638 | A | 7/1979 |
| JP | 55-50457 | A | 4/1980 |
| JP | 55-128570 | A | 10/1980 |
| JP | 57-55789 | B2 | 11/1982 |
| JP | 58-64366 | A | 4/1983 |
| JP | 59-226169 | * | 12/1984 |
| JP | 61-352 | Y2 | 1/1986 |
| JP | 61-227158 | A | 10/1986 |
| JP | 61-266560 | A | 11/1986 |

(Continued)

*Primary Examiner* — Laura Edwards
(74) *Attorney, Agent, or Firm* — Birch, Stewart, Kolasch & Birch, LLP

(57) ABSTRACT

A liquid wiping apparatus that can eliminate the increase in the thickness of membranous liquid and defects in the surface quality resulting from the attachment of splash onto the surface of a metallic strip and can improve the productivity in a manner of accelerating the line speed is provided. The liquid wiping apparatus includes blade wipers for contacting with a molten metal having been attached onto the metallic strip 1 to mechanically wipe the molten metal. In the liquid wiping apparatus, a pressure applying unit 7 of the static pressure pad type using gas is installed at the outlet side of the blade wiper 6 in the strip running direction, and phase-mixed flow of gas/liquid 15 is produced in membranous liquid running between the blade wiper 6 and the strip 1.

8 Claims, 9 Drawing Sheets

FOREIGN PATENT DOCUMENTS

| | | | |
|---|---|---|---|
| JP | 62-205256 | A | 9/1987 |
| JP | 62-205260 | A | 9/1987 |
| JP | 2-254147 | A | 10/1990 |
| JP | 3-120348 | A | 5/1991 |
| JP | 4-48057 | A | 2/1992 |
| JP | 4-231448 | A | 8/1992 |
| JP | 5-140721 | A | 6/1993 |
| JP | 7-102354 | A | 4/1995 |
| JP | 7-188888 | A | 7/1995 |
| JP | 8-127854 | A | 5/1996 |
| JP | 9-302453 | A | 11/1997 |
| JP | 11-279736 | A | 10/1999 |
| JP | 11-279737 | A | 10/1999 |
| JP | 3290199 | B2 | 3/2002 |
| JP | 2002-275614 | A | 9/2002 |
| JP | 2003-119556 | A | 4/2003 |
| JP | 2003-321756 | A | 11/2003 |
| JP | 2003-321757 | A | 11/2003 |
| JP | 2005-171336 | A | 6/2005 |
| WO | WO-01/07675 | A1 | 2/2001 |

* cited by examiner

Fig.7-a
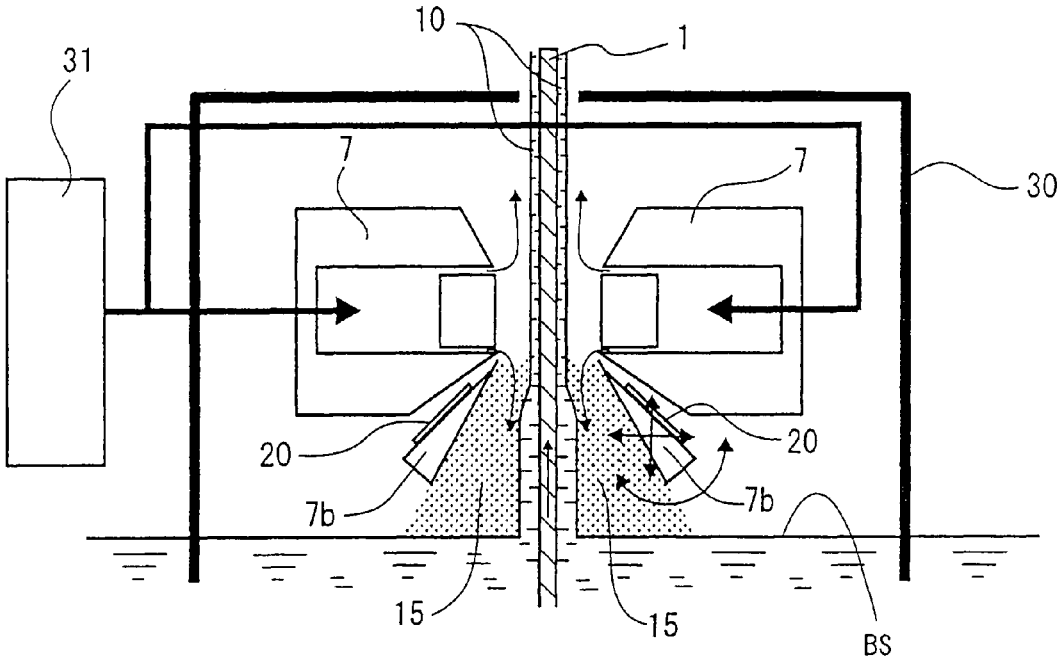

Fig.7-b
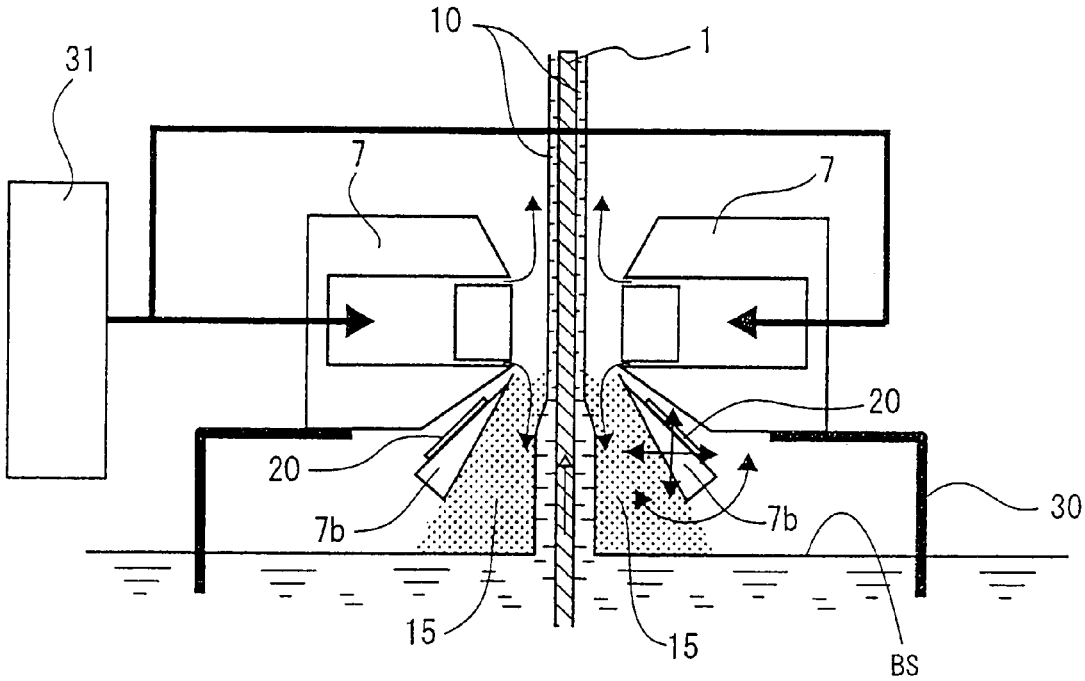

LIQUID WIPING APPARATUS

CROSS REFERENCE TO RELATED APPLICATION

This application is a Divisional Application No. 11/092,576 filed on Mar. 29, 2005, now abandoned, and for which priority is claimed under 35 U.S.C. §120; and this application claims priority of Application No. JP2004-117468 filed in Japan on Apr. 13, 2004 under 35 U.S.C. §119; the entire contents of all are hereby incorporated by reference.

BACKGROUND OF THE INVENTION

1. Field of the Invention

The present invention relates to a liquid wiping apparatus suitably used for an iron manufacturing process line, particularly for a molten metal plating plant in a molten metal plating line using a metal, such as zinc.

2. Description of the Related Art

In general, in a molten metal plating line of this sort, a process in which a strip (a metallic ribbon) having been continuously subjected to a preliminary processing, such as annealing, and held at a high temperature is led via a sink roll installed in a molten plating bath (a molten metal pot) so that it is ascended, the amount of the molten metal to be plated (molten metal thickness, membranous metal thickness) onto the strip is controlled during the ascending process, and the strip is then cooled in a predetermined cooling pattern to normal temperature is employed.

In an example, as shown in FIG. 8, following to that a strip 100 is once drawn into a molten plating bath 101, the strip runs such that the running direction thereof is turned by means of a sink roll 102 installed in the molten plating bath 101 and the strip is further drawn in a vertical direction via support rolls 103 arranged in the bath, so that the excess portion of molten zinc having been attached onto the surfaces of the strip 100 is blown away during the running with gas ejected from a pair of wiping nozzles 104, which are arranged face to face over the molten plating bath 101, to thereby control the amount of the molten zinc to be plated to a predetermined amount (See, Japanese Patent Application Laid-open No. 7-180019 (FIG. 1)).

Note that, in FIG. 8 where reference symbol 105 represents a pair of range finders, an analyzer 106 determines the vibrating state and shape of the strip 100 on the basis of the measurements given by the range finders 105, and a processing computer 107 controls the distance between the strip 100 and the wiping nozzles 104 to such an extent that they approach each other up to a limit at which they can avoid the contact therewith on the basis of the determined vibration and shape.

In addition, as shown in FIG. 9, the strip 100 is subjected to processings, such as surface cleaning, in the preliminary processing furnace, led into the molten plating bath 101, and then drawn upward via a sink roll 102. At a position where the strip is drawn up from the molten plating bath, the running line of the strip 100 is curved in an arc state by a first static pressure pad 108 and a second static pressure pad 109. Under such a circumstance, the excess molten zinc having been attached onto the strip 100 is blown off with gas ejecting from gas ejecting nozzles (slit nozzles) 108*a*, 109*a* for controlling the amount to be attached onto the strip 100, which are installed respectively at the strip-inlet sides of the respective static pressure pads, so that the amount to be attached onto the strip is controlled to a predetermined amount to be plated.

Further, the strip 100 is adapted to be firmly held so as not to vibrate itself with static pressure caused by gas which is ejected from the plating coverage controlling gas ejecting nozzles 108*a*, 109*a* and gas ejecting nozzles (slit nozzles) 108*b*, 109*b* installed respectively at the outlet sides of the respective static pressure pads (See, Japanese Patent Application Laid-open No. 7-102354 (FIG. 1)).

SUMMARY OF THE INVENTION

In the above-descried molten metal plating plant, the production of galvanized steel plates has been carried out generally at a strip running speed of 150 m/min or less. In order to improve the productivity of such a molten metal plating line, it is required to make the running speed of the line faster. However, when the plating line speed, i.e., the strip running speed is changed to be faster, it is required to enhance the wiping performance given by the gas wipers or the static pressure pads. Accordingly, for enhancing the wiping performance, it is also required either to reduce the distance between the strip and the nozzles or to enhance the gas pressure to be ejected.

In the above-described two exemplified molten metal plating plants according to the prior art, however, when the strip running speed exceeds 150 m/min and, for example, the distance between the strip and the nozzles is reduced, the membranous liquid 110 corrupts to thereby produce the splash (scattering of liquid droplets) due to impact of the thick membranous liquid 110, which is attached onto the strip 100 and running therewith, to the wiping gas (refer to arrows shown in FIG. 10) intensively ejected from the wiping nozzle 104 or the like as shown in FIG. 10. As a result, the splashing droplets S diffuse up to the outlet side of the wiper and attach onto the surface of the strip to thereby increase the thickness of the membranous liquid and cause defects in the surface quality. Due to this reason, it has not been not allowable until today to accelerate the plating line speed.

On the other hand, the wiping performance of common blade wipers greatly depends on a distance between a strip and a blade. However, due to such a reason that it is allowed for a strip and a blade to have a distance therebetween of only more or less double of the membranous liquid thickness required at the outlet side of the strip and there is thus a fear that the strip contacts with the blade wiper under a vibrating state of the strip, the blade wiper has not been applied in the past for molten metal plating plants.

Therefore, it is an object of the present invention to provide a liquid wiping apparatus that does not cause increase in the thickness of the membranous liquid due to attachment of the splash onto the strip surface and defects in the surface quality and can accelerate the line speed to thereby increase the production performance.

The liquid wiping apparatus according to the present invention for attaining the above-described object includes blade wipers adapted to make contact with liquid attaching onto a strip to mechanically wipe the liquid and pressure applying means using gas are disposed respectively at the outlet sides of the respective blade wipers in the strip running direction, and that phase-mixed flow of gas/liquid that flows in a direction opposite to the strip running direction is produced in the membranous liquid portion running between the blade wiper and the strip.

Alternatively, the liquid wiping apparatus according to this invention includes blade wipers adapted to make contact with liquid attaching onto a strip to mechanically wipe the liquid and a pressure applying means using gas is installed at the inlet side of the blade wipers in the strip running direction, and that phase-mixed flow of gas/liquid that flows in a direction opposite to the strip running direction, is produced in the membranous liquid portion running between the blade wiper and the strip.

Further, in the liquid wiping apparatus according to this invention, at least any of the angle of the blade wiper, the distance from the surface of the bath to the blade wipers, and the distance thereof from the strip is configured to be changeable.

Still further, the liquid wiping apparatus according to this invention is characterized by further including a heating means for heating the blade wipers.

Still further, in the liquid wiping apparatus according to this invention a space occupying the section of from the bath surface to the blade wiper is enclosed in a casing so that the interior of the casing is maintained in non-oxidizing or reducing atmosphere.

Alternatively, the liquid wiping apparatus according to this invention is configured such that it has a plurality of slit nozzles for ejecting gas at the upper and lower parts of the apparatus and wipes liquid attached onto the strip by means of the static pressure pads that can produce static pressure in an area between the slit nozzles, and that the distal ends of the static pressure pads are disposed so that they contact with the liquid when the wiping operation is performed, and phase-mixed flow of gas/liquid, that flows in a direction opposite to the strip running direction, is produced in the membranous liquid portion running between the inlet sides of the static pressure pads in the strip running direction and the strip.

Still further, in the liquid wiping apparatus according to this invention the inlet side face section of the static pressure pad is formed separately from the later and at least one of the angle of the inlet side face section, the distance thereof from the bath surface and the distance thereof from the strip is configured so to be changeable.

Still further, the liquid wiping apparatus according to this invention further includes heating means for heating the portion of the static pressure pad where it contacts with liquid.

Still further, in the liquid wiping apparatus according to this invention the heating means is adapted to heat gas ejected from the slit nozzles up to a temperature equal to or higher than the solidifying point and feed the heated gas.

Still further, in the liquid wiping apparatus according to this invention a space occupying the section of from the bath surface to the static pressure pads is enclosed in a casing and the interior of the casing is maintained in non-oxidizing or reducing atmosphere.

Still further, the liquid wiping apparatus according to this invention circulates the non-oxidizing or reduces gas inside the casing to raise the pressure therein and then ejects the gas through the slit nozzles of the static pressure pads.

Still further, the liquid wiping apparatus according to this invention configures the gap between the slits of the slit nozzles to be changeable at a position in an arbitrary width direction thereof.

Still further, the liquid wiping apparatus according to this invention applies a metal of which surface being processed, low-carbon stainless steel, or a fine ceramic to a portion of the blade wiper or the static pressure pad where it contacts with the liquid.

With the liquid wiping apparatuses configured as described above according to the present invention, the wiping performance is enhanced, and in addition, the occurrence of the splash is reduced, since the surface side of the membranous liquid tends to be easily blown off toward the inlet side of either the blade wiper or the static pressure pad in the strip running direction due to the phase-mixed flow of gas/liquid, that flows in a direction opposite to the strip running direction, produced in the membranous liquid running between said inlet side in the strip running direction and the strip. Thus, it is permitted to distance the pressure applying means, including the blade wipers and the static pressure pads, and the pressure reducing means from the strip, whereby allowing the strip to previously avoid from contacting with the pressure applying means, including the blade wipers and the static pressure pads, and the pressure reducing means under the vibrating state of the strip. As a result, the acceleration of line speed can be feasible, and the accuracy in the thickness of the membranous liquid and the surface quality can be improved.

Further, the angle of the inlet side face section, which is formed separately from the main body sections of the blade wiper and the static pressure pad, and the distance from the strip to the inlet side face section may be modified appropriately to thereby adjust the pressure of the pressure applying means, including the static pressure pads and the pressure reducing means, and the sensitivity for the thickness of the membranous liquid. The inlet side face section separately formed is naturally replaceable when it is corroded or the like.

Further, the liquid contacting portions of the blade wipers and the static pressure pads, or the ejecting gas in the pressure applying means including the static pressure pad may be heated to thereby prevent the liquid, such as molten metal and the like, from solidification.

Further, the space occupying the section of from the bath surface to the blade wipers and the static pressure pads may be enclosed in a casing so as to maintain the interior of the casing in non-oxidizing or reducing atmosphere to thereby prevent the liquid, such as a molten metal or the like, having been blown off in the form of the part of the phase-mixed flow of gas/liquid from being oxidized. It is naturally possible to circulate the non-oxidizing or reducing gas in the casing to thereby raise the pressure there, and then to eject the gas through the slit nozzles of the static pressure pads to thereby reduce the consumption of the non-oxidizing or reducing gas.

Further, the gap between the slits of the slit nozzles of the static pressure pads may be modified in an arbitrary width direction thereof to control the wiping thickness in the width direction of the strip.

Finally, a metal of which surface being processed, low-carbon stainless steel, or a fine ceramic may be applied to a portion of the blade wiper or the static pressure pad where it contacts with the liquid to improve the corrosion resistance of said portion.

BRIEF DESCRIPTION OF THE DRAWINGS

FIG. 7*a* is a side view of the main portion of a plating coverage control section and the vicinity thereof in a molten metal plating line according to Example 6 for the present invention;

FIG. 7*b* is a side view of the main portion of a plating coverage control section and the vicinity thereof in a molten metal plating line according to the modification of Example 6 for the present invention;

DETAILED DESCRIPTION OF THE INVENTION

The liquid wiping apparatus according to the present invention will now be explained in detail by means of the following examples with referring to the appended drawings.

Example 1

Figure 1:
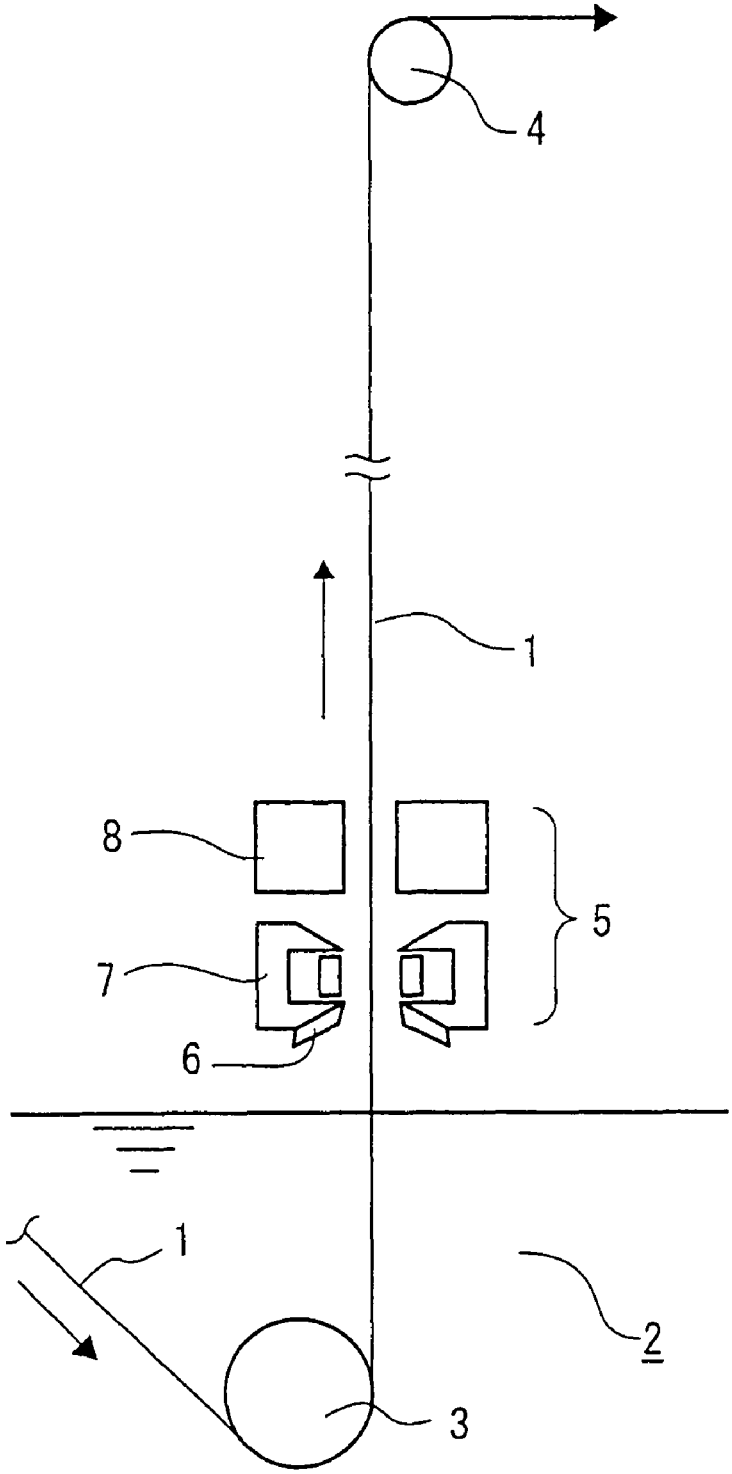
FIG. 1 is a side view of a plating coverage control section and the vicinity thereof in a molten metal plating line according to Example 1 for the present invention.
Figure 2:
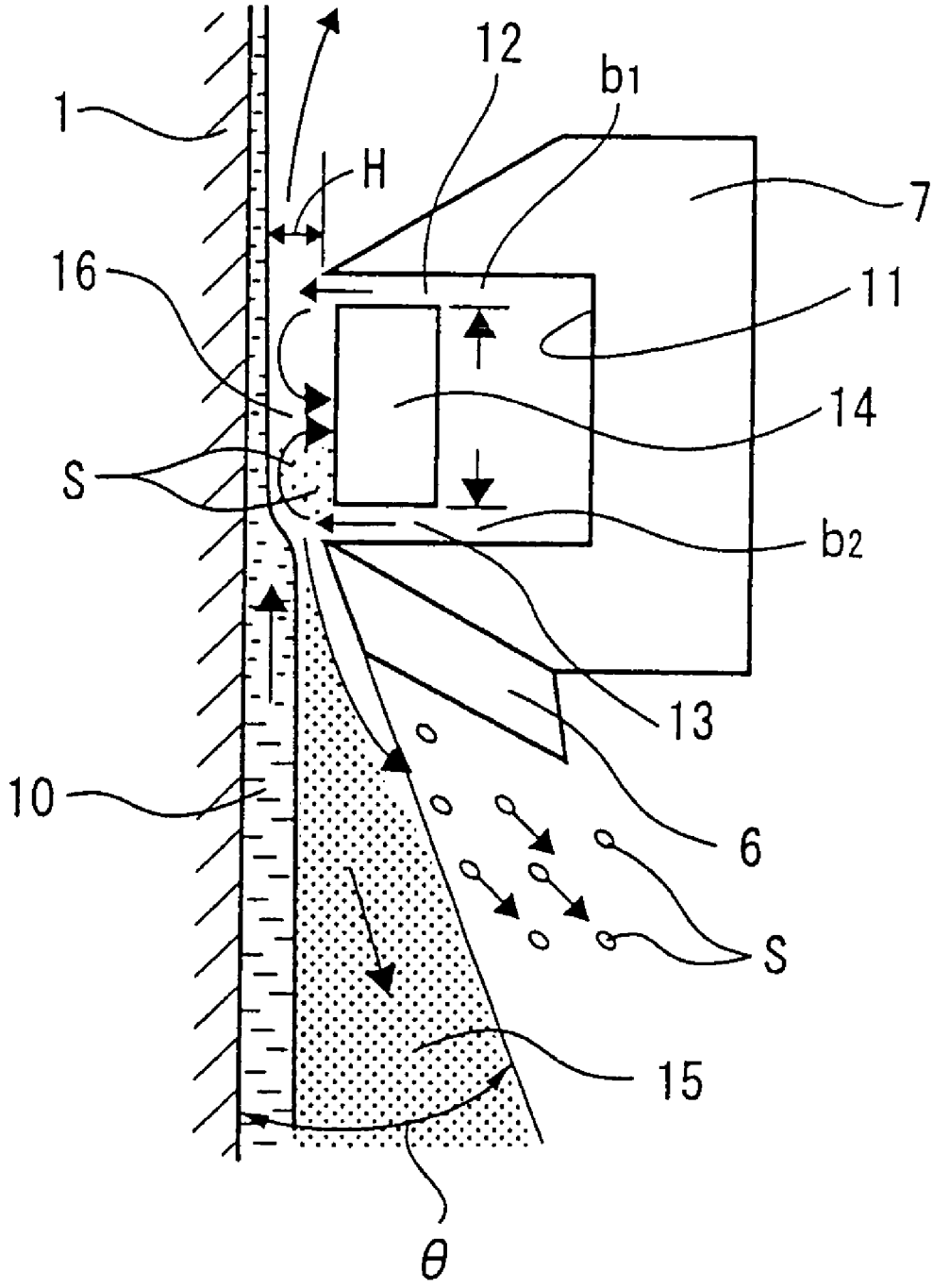
FIG. 2 is an enlarge sectional view of the main portion shown in FIG. 1.

FIG. 1 is a side view of the plating coverage control section and the vicinity thereof in the molten metal plating line according to Example 1, and FIG. 2 is an enlarged view of the main portion shown in FIG. 1.

In FIG. 1, a strip (a steel ribbon) 1 is adapted to be fed upward via a sink roll 3 installed in a molten metal pot (a molten plating bath) 2 and to be taken out in the lateral direction from a top roll 4 in the completely-plated state following to having been subjected to a prefixed post processings.

In FIG. 1, the represented by reference symbol 5 is a plating thickness control unit disposed so as to oppose both faces (the front and reverse faces) of the strip 1 that runs upward in the vicinity of the molten metal pot 2. This plating thickness control unit 5 includes a blade wiper 6 disposed at a prefixed height near the bath surface, a pressure applying means 7 not contacting with the strip and integrally fixed to the outlet side portion of the blade wiper 6, and a non-contacting strip control means 8 not contacting with the strip and disposed in the downstream side from the pressure applying means in the plating line. Although this strip control means 8 is configured in one step in FIG. 1, the strip control means in a plurality of steps may be disposed in the running direction of plating.

In FIG. 2, a specific example of the plating thickness control unit 5 is shown. In this drawing, although a plating thickness control unit 5 in only the unilateral side of the strip 1 is shown, two plating thickness control units are disposed symmetrically to the both sides of the strip 1 in situ. Note that, in FIG. 2, reference symbol 10 denotes a membranous plating metal, which has been attached to the both faces of the strip in the molten metal pot 2 and is carried with the strip upward.

In FIG. 2, the blade wiper 6 is made from a heat resistant metal, a ceramic or the like, to which a molten plating metal does not adhere, and is supported so as to form a predetermined angle θ between itself and the strip 1.

For the pressure applying means 7 in this example, a static pressure pad (mechanism) having both pressure applying function and vibration control function is employed. The pressure applying means 7 of this type includes at least two slit nozzles 12 and 13 (two in the example of FIG. 2), which are made longer in the dimension in the width direction and are disposed respectively in the upper and lower positions of an air or gas supply chamber 11 with a longer dimension in the width direction of the strip 1, and a pressure resistant wall 14 disposed in a space extending between the upper and lower slit nozzles 12, 13 so as to be in parallel to a face of the strip 1.

The air or gas ejected from the upper and lower slit nozzles 12, 13 form a highly-pressured region in the outlet side of the blade wiper 6. The highly-pressured region functions to produce a phase-mixed flow of gas/liquid (liquid droplets flow) 15, that flows in a direction opposite to the strip running direction, on the surface of the membranous plating metal 10 in the region between the blade wiper 6 and the strip 1 at the inlet side of the blade wiper 6 by making use of pressure difference caused between the inlet and outlet sides of the blade wiper 6. Additionally, the highly-pressured region also functions to cause a static pressure region 16 in the space surrounded by ejected gas flow from the upper and lower slit nozzles 12, 13 and maintain it so that the static pressure is equipoised at the both sides of the strip 1 to thereby control the vibration of the strip 1.

Note that it is preferable, in the pressure applying means 7 shown in FIG. 2, to configure the gap H extending from the slit nozzles 12, 13 to the strip 1 and the angle θ of the blade wiper 6 to be controllable.

For example, it has been proven that, in the experiments made by the inventors, etc., when the strip 1 is operated at a running speed range of from 150 m/min to 300 m/min, and the gap H extending from the slit nozzles 12, 13 to the face of the strip 1 is fixed to a distance six times longer or less of the slit thicknesses (gaps b1 and b2) of the slit nozzles 12, 13, the blowing pressure can be stabilized even in the presence of vibration of the strip 1. Further, it has been also proven in the experiments by the inventors, etc. that it becomes hard to produce the phase-mixed flow of gas/liquid (liquid droplets flow) 15 if the angle θ of the blade wiper 6 is too great, because the flow speed is reduced due to the fluid flow path being too wide, and therefore, it is appropriate to form said angle at a degree less than 45°.

With the configuration as described above, the strip 1 can be moved upward from the sink roll 3 at a strip running speed range, for example, of from 150 m/min to 300 m/min. The strip 1 comes into an area between the blade wipers 6 together with the molten plating metal in an excess amount having been attached onto the both faces of the strip, where the excess molten plating metal temporarily attaching onto the strip is sliced off (wiped) by the controlled clearance (gap) between the blade wipers 6.

During that wiping, the air or gas ejected through the slit nozzles 12, 13 of the pressure applying means 7 run up against the face of the strip 1 to flow both upward and downward, with which the secondary wiping of the excess molten plating metal is effected. At the same time, resulting from the pressure difference caused between the inlet and outlet sides of the blade wiper 6, the phase-mixed flow (liquid droplets flow) 15 of gas/liquid, that flows in a direction opposite to the strip running direction, is produced on the surface of the membranous plating metal 10 running between the blade wiper 6 and the strip 1 at the inlet side of the blade wiper 6.

With said flow, the excess molten plating metal at the surface side of the membranous plating metal 10 tends to be easily blown off, which contributes to improve the wiping performance and to prevent the splash from occurring. Also, with the vibration control operation given by the static pressure section 16 of the pressure applying means 7, the vibration of the strip 1 can be reduced. Further, since the splash S occurring as a result of the impact of the gas jet at the static pressure section 16 is enclosed in said gas jet ejected from the upper slit nozzle 12 of the pressure applying means 7, the splash is not discharged upwardly from the pressure applying means 7. Accordingly, it is permitted to distance the blade wiper 6 and the pressure applying means 7 from the strip 1, whereby contact of the strip 1 with the blade wiper 6 and the pressure applying means 7 under the vibrating state of the strip 1 can be obviated.

With the configuration as described above, enhancement of the line speed and improvement of the productivity will be achieved as well as improvement of the accuracy in the thickness of the membranous plating metal and the surface quality. Additionally, cost reduction based on low power supply (less pressure of gas) and reduction of noise will also be achieved.

Furthermore, since the pressure applying means 7 has the vibration control function in this example, the dedicated strip control means 8 shown in FIG. 1 may be omitted or the numbers thereof to be installed may be reduced.

Example 2

Figure 3:
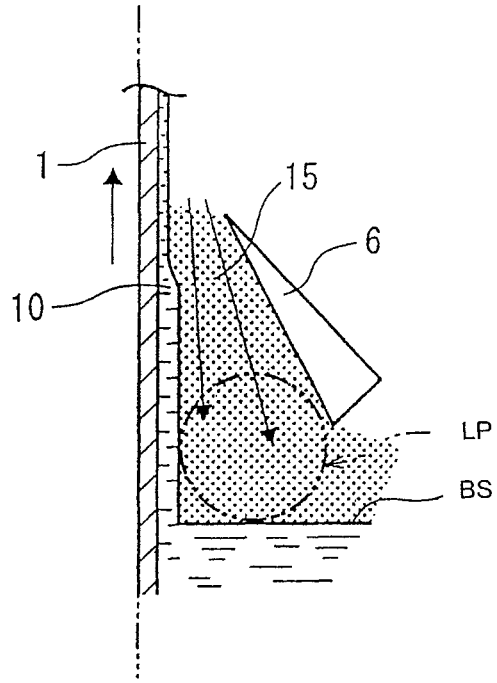
FIG. 3 is a side view of the main portion of a plating coverage control section and the vicinity thereof in a molten metal plating line according to Example 2 for the present invention.

FIG. 3 is a side view of the main portion of the plating coverage control section and the vicinity thereof in the molten metal plating line according to Example 2 for the present invention. In the drawing, although the plating coverage control section only in the unilateral side is shown, two plating coverage control sections are disposed symmetrically to the both sides of the strip 1 in situ.

In this example, the pressure applying means 7 employed in Example 1 is not included, and instead thereof, a low atmospheric pressure region LP is produced at the inlet side of the blade wiper 6 in the strip running direction by means of a pressure reducing means using gas, such as a vacuum pump, and the phase-mixed flow of gas/liquid 15, that flows in a direction opposite to the strip running direction, is produced in the membranous liquid running between the blade wiper 6 and the strip 1 by making use of the pressure difference caused between the inlet and outlet sides of the blade wiper 6, similarly to the pressure applying means 7 as described above.

In this example as well, improvement of the wiping performance and reduction of the splash occurrence can be achieved. Further, since the blade wiper 6 can be distanced from the strip 1, the contact of the strip 1 with the blade wiper 6 can be obviated even under a vibrating state of the strip 1.

As a result, enhancement of the line speed and improvement of the productivity will be achieved as well as improvement of the accuracy in the thickness of the membranous liquid and the surface quality.

Example 3

Figure 4:
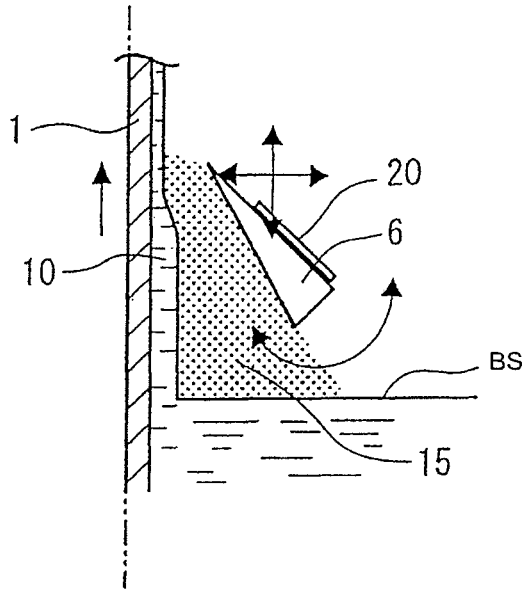
FIG. 4 is a side view of the main portion of a plating coverage control section and the vicinity thereof in a molten metal plating line according to Example 3 for the present invention.

FIG. 4 is a side view of the main portion of the plating coverage control section and the vicinity thereof in the molten metal plating line according to Example 3 for the present invention. In the drawing, although the plating coverage control section only in the unilateral side is shown, two plating coverage control sections are disposed symmetrically to the both sides of the strip 1 in situ.

In this example, the angle of the blade wiper 6, the distance thereof from the bath surface BS, and the distance thereof from the strip 1, as described in Examples 1 and 2, are configured to be controllable, thereby allowing the sensitivity of the pressure applying means 7 or the pressure reducing means to the pressure and thickness of the membranous liquid to be controllable, and a heating means, such as a heater 20, is equipped to the blade wiper 6 to prevent the molten metal (the phase-mixed flow of gas/liquid 15) from solidifying.

Example 4

Figure 5:
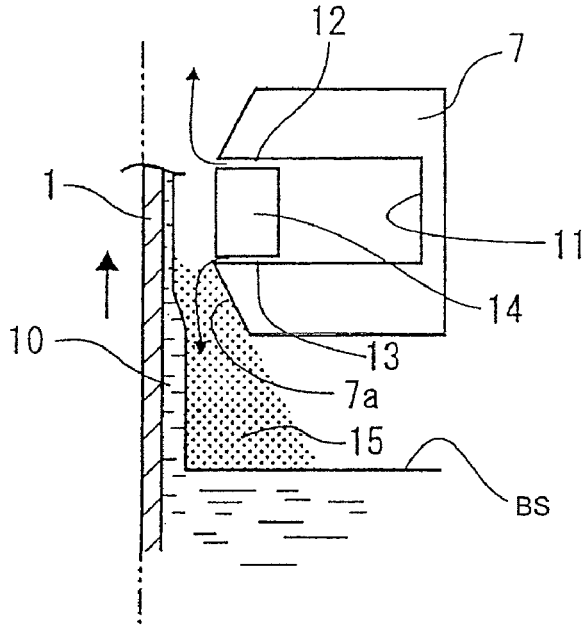
FIG. 5 is a side view of the main portion of a plating coverage control section and the vicinity thereof in a molten metal plating line according to Example 4 for the present invention.

FIG. 5 is a side view of the main portion of the plating coverage control section and the vicinity thereof in the molten metal plating line according to Example 4 for the present invention. In the drawing, although the plating coverage control section only in the unilateral side is shown, two plating coverage control sections are disposed symmetrically to the both sides of the strip 1 in situ.

In this example, the blade wiper 6 employed in Example 1 is not included, and instead thereof, a pressure applying means 7 of the static pressure pad type is disposed such that the distal end of the lower slit nozzle 13 contacts with the molten metal during a period of wiping, and the phase-mixed flow of gas/liquid 15, that flows in a direction opposite to the strip running direction, is produced in the membranous liquid running between the inlet side face 7*a*, which is cut on the bias so as to make the inlet side wider, of the pressure applying means 7 of the static pressure pad type in the strip running direction and the strip 1. In this configuration, air or gas in the pressure applying means 7 of the static pressure pad type is heated and fed so that the contacting portion (contact-with-liquid portion) of the pressure applying means 7 of the static pressure pad type with the molten metal is maintained at a temperature equal to or higher than the solidifying point of the molten metal. Alternatively, the portion contacting with the molten metal, for example, said inlet side face 7*a* in the strip running direction may be heated by means of a heating means.

In this example, the similar operations and advantageous effects to those in Example 1 can be achieved. Furthermore, such an advantage that the solidification of the molten metal can be prevented from occurring is also obtainable.

Example 5

Figure 6:
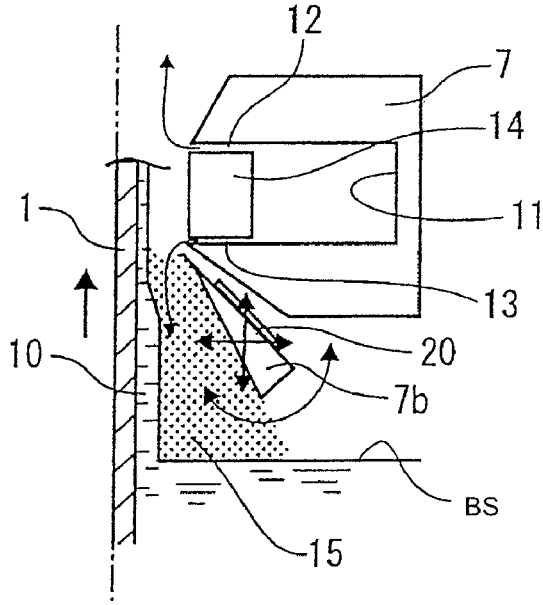
FIG. 6 is a side view of the main portion of a plating coverage control section and the vicinity thereof in a molten metal plating line according to Example 5 for the present invention.
Figure 8:
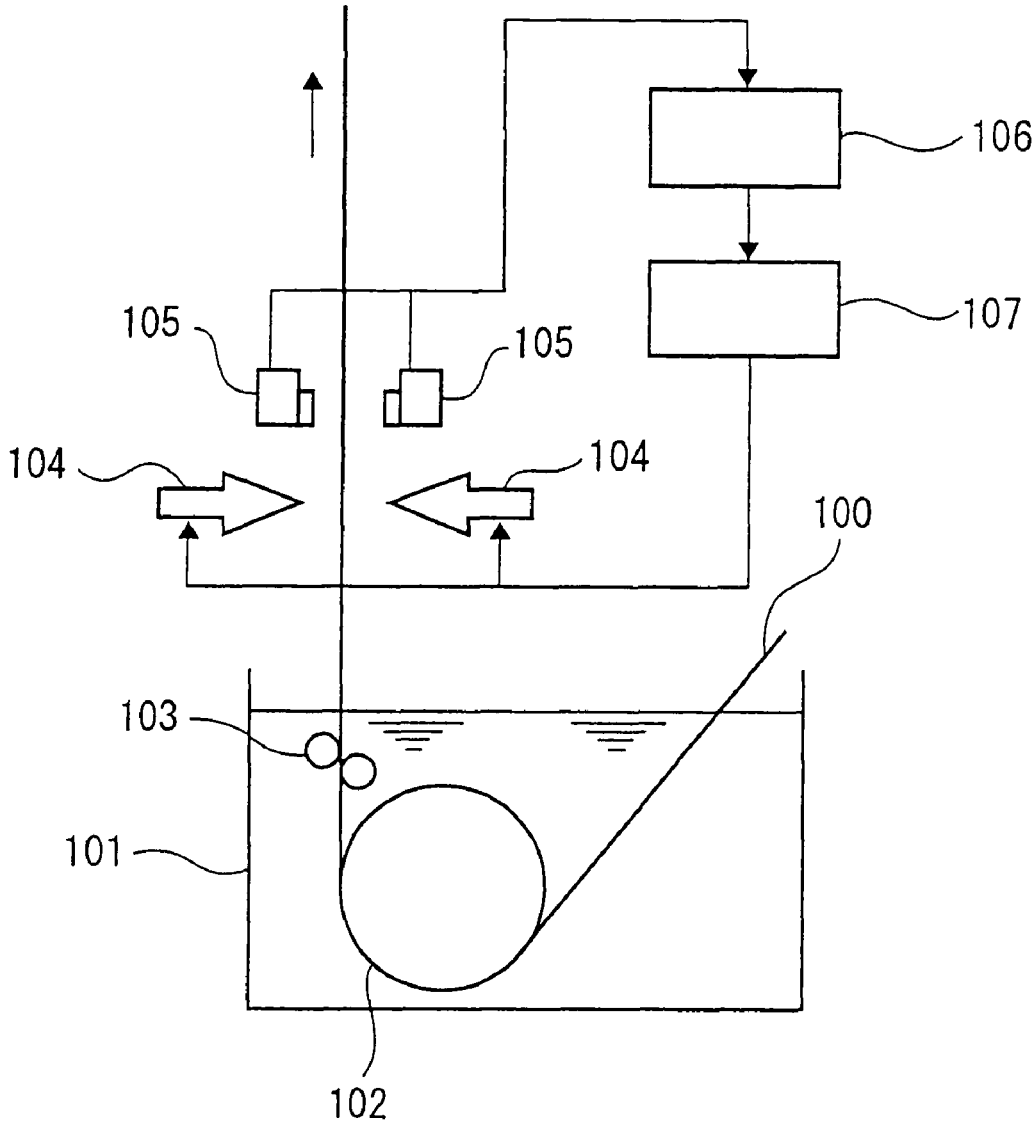
Fig.8 Related Art
FIG. 8 is a side view of a plating coverage control section and the vicinity thereof in a molten metal plating line according to the prior art.
Figure 9:
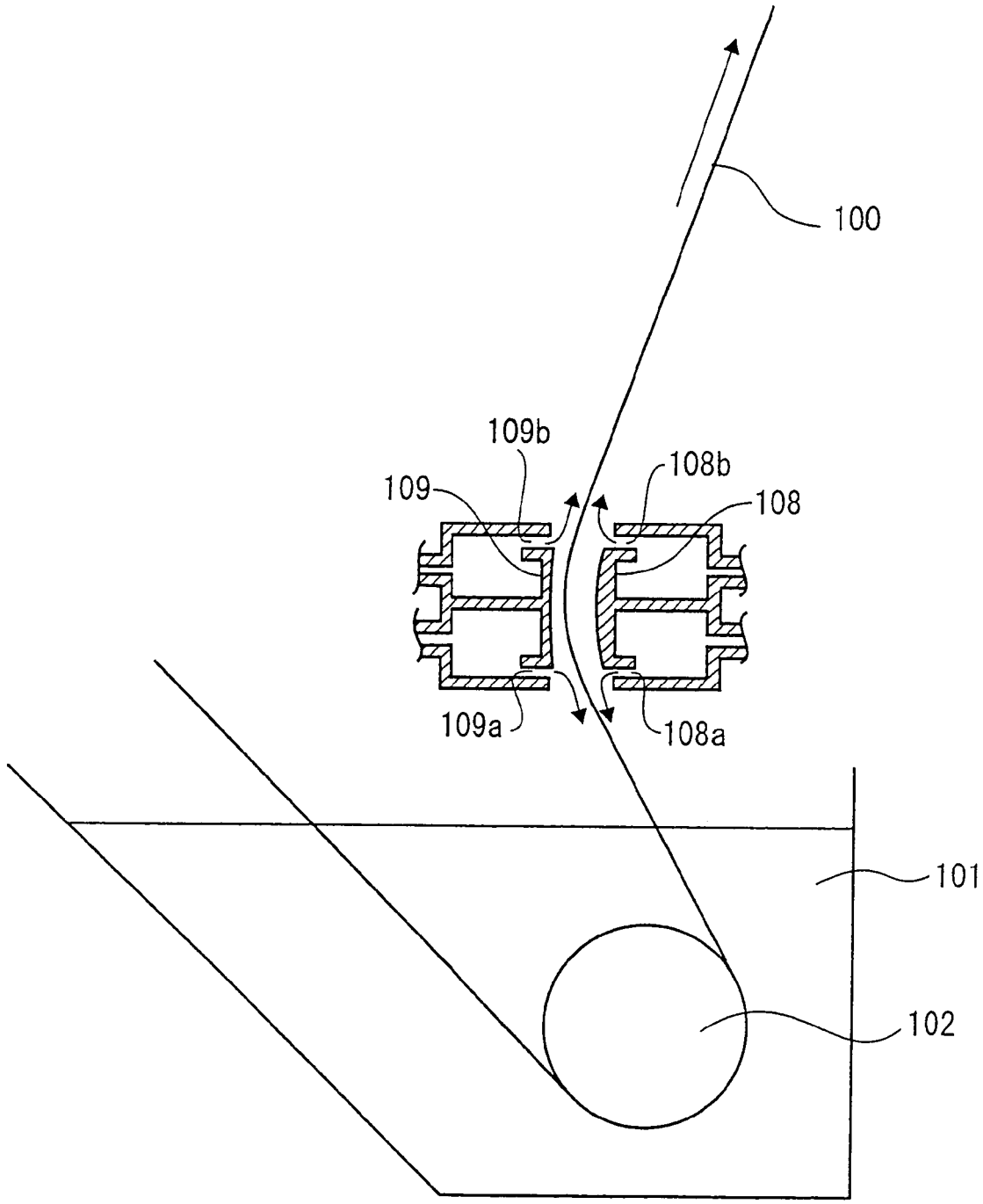
Fig.9 Related Art
FIG. 9 is a side view of a plating coverage control section and the vicinity thereof in another molten metal plating line according to the prior art.
Figure 10:
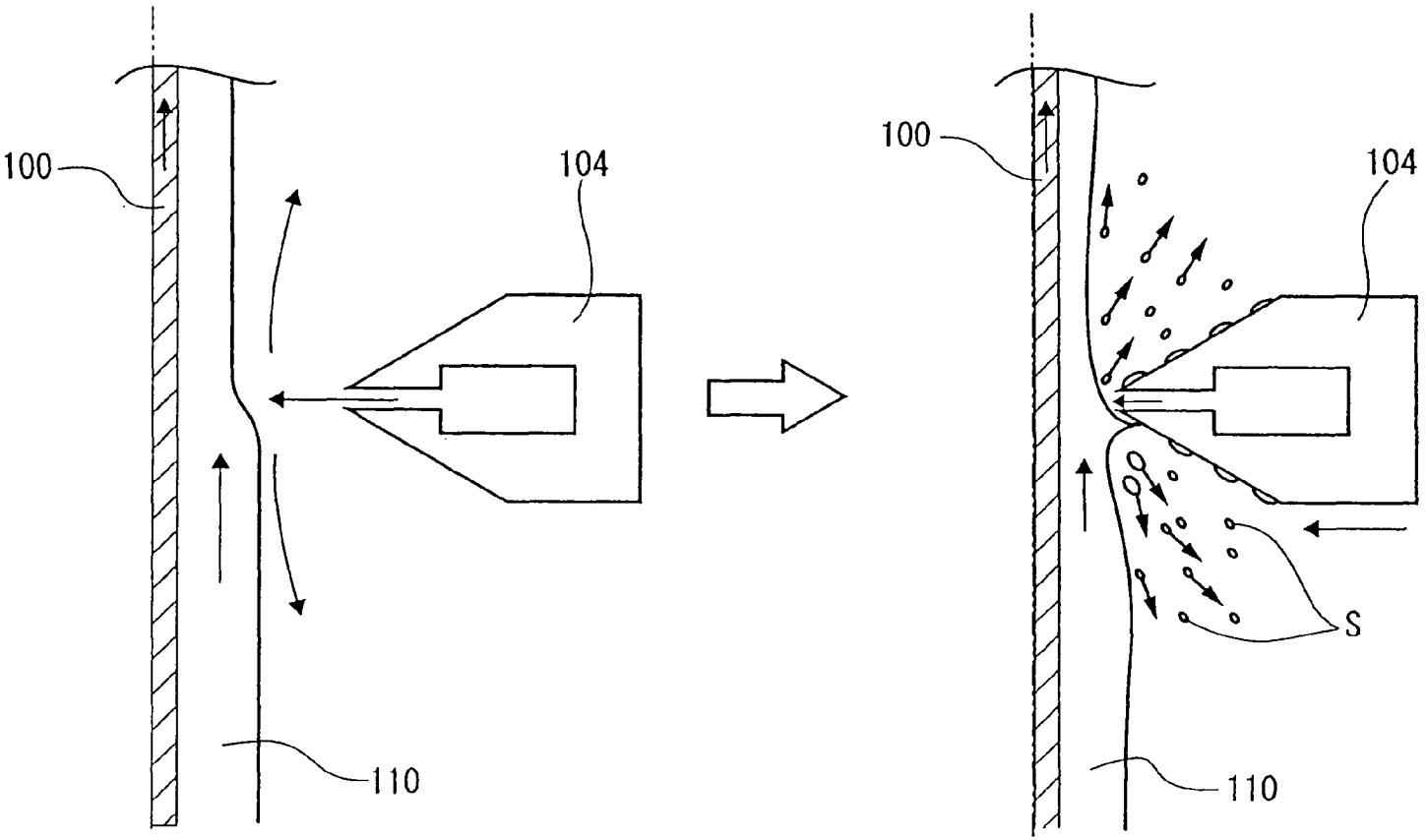
Fig.10 Related Art
FIG. 10 is an explanatory view illustrating a defect at a plating coverage control section in a molten metal plating line according to the prior art.

FIG. 6 is a side view of the main portion of the plating coverage control section and the vicinity thereof in the molten metal plating line according to Example 5 for the present invention. In the drawing, although the plating coverage control section only in the unilateral side is shown, two plating coverage control sections are disposed symmetrically to the both sides of the strip 1 in situ.

In this example, it is configured such that the inlet side face of the pressure applying means 7 of the static pressure pad type in the strip running direction as described in Example 4 is formed separately from the pressure applying means 7 as an inlet side face section 7*b* in the strip running direction, and the angle of said inlet side face section 7*b*, the distance thereof from the bath surface, and the distance thereof from the strip 1 are controllable, and said inlet side face section 7*b* is heated by means of a heater 20.

In this example as well, similar operations and advantageous effects to those in Example 1 are achievable. Furthermore, such advantages that the pressure of the pressure applying means 7 of the static pressure pad type and the sensitivity of the membranous liquid is made controllable, and that the solidification of the molten metal (the phase-mixed flow of gas/liquid 15) is prevented from occurring can be obtained. In addition, it is also an advantage that the inlet side face section 7*b* in the strip running direction is exchangeable when it is corroded.

Example 6

FIG. 7*a* and FIG. 7*b*, respectively, is a side view of the main portion of the plating coverage control section and the vicinity thereof in the molten metal plating line according to Example 6 for the present invention.

In the example shown in FIG. 7*a*, it is configured such that the space occupying the section of from the bath surface BS to the pressure applying means 7 of the static pressure pad type as described in Example 5 is enclosed in a casing 30, a gas-compressing-feeding means 31 elevates pressure of non-oxidizing or reducing gas to eject the gas through the slit nozzles 12, 13 of the pressure applying means 7 of the static pressure pad type and to thereby produce the phase-mixed flow of gas/liquid 15, and the molten metal having been sliced off is prevented by said phase-mixed flow from oxidizing. It is naturally an additional advantage that noise produced by the wiper can be enclosed in the casing 30. In the example shown in FIG. 7*b*, the casing 30 is disposed in such a manner that it attach to the lower face of the pressure applying means 7 so that gas to be discharged upward from the pressure applying means 7 does not come into the casing 30. This example has such an advantage that the casing can be made in a compact size.

The above-described example may also be configured such that the non-oxidizing or reducing gas in the casing 30 is circulated into the gas-compressing-feeding means 31, then pressured there, and subsequently fed to the pressure applying means 7 of the static pressure pad type. Note that this example may be applied to Examples 1 to 4.

In the respective Examples described above, the apparatus may also be configured in such a type that the gas ejected from the pressure applying means 7 is heated so that the molten metal is prevented from solidifying. Alternatively, the slit gap of the slit nozzles 12, 13 of the pressure applying means 7 of the static pressure pad type may be made controllable in an arbitrary position in the width direction thereof so that the thickness to be wiped in the width direction of the strip 1 is made controllable. Further, a metal of which surface being processed, low-carbon stainless steel, or a fine ceramic may be applied to the portion, where it contacts with the molten metal, of the blade wiper 6 or the pressure applying means 7 of the static pressure pad type to thereby improve the corrosion resistance of said portion. In the respective Examples described above, the liquid wiping apparatus according to the present invention is exemplarily applied for the molten metal plating plant in the molten metal plating line, such as zinc, it is needless to say that the inventive liquid wiping apparatus can naturally be applied for the other plant (e.g., coating plant) in a process line for a ribbon-shaped material.

What is claimed is:

1. A liquid wiping apparatus including a plurality of slit nozzles for ejecting gas at upper and lower positions in the apparatus and wiping liquid attached onto a metallic strip by a static pressure pad capable of producing static pressure in a region between the slit nozzles, wherein a distal end of the static pressure pad is disposed so as to contact with the liquid when wiping is carried out, and phase-mixed flow of gas/liquid, that flows in opposite to the strip running direction, is produced in a membranous liquid running between an inlet side of the static pressure pad in the strip running direction and the strip.

2. A liquid wiping apparatus as claimed in claim 1, wherein an inlet side face section of the static pressure pad is formed separately from the static pressure pad and at least one of the angle of the inlet side face section, the distance thereof from a bath surface, and the distance thereof from the strip is configured to be controllable.

3. A liquid wiping apparatus as claimed in claim 1, wherein a heating unit that heats a contact-with liquid portion of the static pressure pad is further included.

4. A liquid wiping apparatus as claimed in claim 3, wherein gas ejected from the slit nozzles is heated up to a temperature equal to or higher than a solidifying point and is then fed as the heating unit.

5. A liquid wiping apparatus as claimed in claim 1, wherein a space occupying the section of from a bath surface to the static pressure pad is enclosed in a casing, and the interior of the casing is maintained in non-oxidizing or reducing atmosphere.

6. A liquid wiping apparatus as claimed in claim 5, wherein the non-oxidizing or reducing gas in the casing is circulated, then pressured, and subsequently ejected through the slit nozzles of the static pressure pad.

7. A liquid wiping apparatus as claimed in claim 1, wherein the slit gap of the slit nozzle is made controllable in an arbitrary position in the width direction thereof.

8. A liquid wiping apparatus as claimed in claim 1, wherein a surface-processed metal, a low-carbon stainless steel, or a fine ceramic is applied to a portion of said static pressure pad where the static pressure pad contacts with the liquid.

* * * * *